US006938856B2

(12) United States Patent
Frontera Castaner

(10) Patent No.: US 6,938,856 B2
(45) Date of Patent: Sep. 6, 2005

(54) EMPENNAGE ASSEMBLY AND ATTACHMENT MECHANISM FOR A MODEL AIRPLANE

(75) Inventor: Miguel A. Frontera Castaner, St. Joseph, IL (US)

(73) Assignee: Hobbico, Inc., Champaign, IL (US)

( * ) Notice: Subject to any disclaimer, the term of this patent is extended or adjusted under 35 U.S.C. 154(b) by 167 days.

(21) Appl. No.: 10/690,065

(22) Filed: Oct. 21, 2003

(65) Prior Publication Data

US 2005/0082425 A1 Apr. 21, 2005

(51) Int. Cl.[7] ..... B64C 9/02

(52) U.S. Cl. ..... 244/87; 244/131; 244/120; 446/57

(58) Field of Search ..... 244/89, 87, 131, 244/120, 123; 446/36, 56, 57, 58, 35, 37, 38, 39, 40, 41

(56) References Cited

U.S. PATENT DOCUMENTS

| | | | | | |
|---|---|---|---|---|---|
| 2,378,885 | A | * | 6/1945 | Watter | 244/117 R |
| 2,787,185 | A | * | 4/1957 | Rea et al. | 411/49 |
| 3,219,158 | A | * | 11/1965 | Carter et al. | 52/84 |
| 3,640,491 | A | * | 2/1972 | Harrison | 244/117 R |
| 3,827,181 | A | * | 8/1974 | Mabuchi | 446/57 |
| 3,935,664 | A | * | 2/1976 | Neuhierl | 446/34 |
| 4,148,450 | A | * | 4/1979 | Neuhierl | 244/124 |
| 4,233,773 | A | | 11/1980 | Jones | |
| 4,417,708 | A | * | 11/1983 | Negri | 244/45 R |
| 4,591,114 | A | * | 5/1986 | Block | 244/120 |
| 5,009,374 | A | * | 4/1991 | Manfredi et al. | 244/1 R |
| 5,064,145 | A | * | 11/1991 | Wagener | 244/87 |
| 5,941,478 | A | * | 8/1999 | Schmittle | 244/48 |
| 6,186,854 | B1 | | 2/2001 | Lai | |
| 6,217,404 | B1 | | 4/2001 | Liao | |
| 6,612,893 | B2 | * | 9/2003 | Rehkemper et al. | 446/34 |
| 2003/0082991 | A1 | | 5/2003 | Tian et al. | |

FOREIGN PATENT DOCUMENTS

| | | | | |
|---|---|---|---|---|
| DE | 3538483 | * | 4/1987 | 244/131 |
| GB | 2 145 991 A | | 4/1985 | |
| JP | 5-118797 A | | 5/1993 | |
| JP | 405118797 | * | 5/1993 | 244/87 |

* cited by examiner

*Primary Examiner*—Tien Dinh
(74) *Attorney, Agent, or Firm*—Gardner Carton & Douglas

(57) ABSTRACT

An empennage assembly for a model aircraft. The empennage assembly includes a fuselage having a bottom portion with an opening and a housing positioned in the opening in the bottom portion of the fuselage. The housing has a first end defining an opening and a second end. A rod extends from an underside of a vertical stabilizer, and a horizontal stabilizer having a hole is aligned with the opening in the bottom portion of the fuselage, the housing and the rod, whereby the rod is positioned within the opening in the first end of the housing to secure the vertical and horizontal stabilizers to the fuselage. A method and device for attaching an empennage assembly to a model aircraft are also disclosed.

10 Claims, 3 Drawing Sheets

EMPENNAGE ASSEMBLY AND ATTACHMENT MECHANISM FOR A MODEL AIRPLANE

FIELD OF THE INVENTION

This invention pertains to assembly components for a model aircraft and, more particularly, to an empennage assembly that can be attached to a model airplane without the use of tools.

BACKGROUND OF THE INVENTION

When building a model of any kind, it is important to make sure that all of the various pieces of the model are aligned and securely attached to one another. This is important not only for aesthetic reasons but also to allow an operating model to function properly. One of the most important sections to assemble with respect to a model airplane is the empennage section. This section, which is also known as a tail assembly, includes flight control surfaces known as the vertical and horizontal stabilizers.

In order for an aircraft to properly fly, the empennage must be precisely aligned and attached to the fuselage. The need for this alignment is self-evident to anyone who has ever flown a real or model airplane, as the empennage and its component parts, the vertical and horizontal stabilizers, are critical to the control and stability of the aircraft.

The vertical stabilizer (also called the tail fin) includes the control surface known as the rudder. The rudder is used to control the aircraft's motion along the yaw axis and thus allow the nose of the aircraft to move left or right. The rudder is also important in aiding the pilot with maintaining what is known as balanced flight during a turn. This is because correct positioning of the rudder results in the tail of the aircraft directly following the line of flight of the nose of the aircraft through a turn, thereby eliminating a skidding or slipping of the aircraft.

The horizontal stabilizer controls the aircraft's motion along the pitch axis. This control surface allows the nose of the aircraft to pitch up or down so as to allow the airplane to climb or descend. Both the horizontal and vertical stabilizers work in conjunction with the ailerons on the wings to allow the airplane to move in all three axes (i.e., yaw, pitch and roll). Needless to say, if either the vertical or the horizontal stabilizer should separate from the aircraft, catastrophic results could occur. For this reason, it is important that a model aircraft have an empennage assembly that can be easily and securely fastened to the fuselage. In addition, for the model enthusiast, it is important to have an empennage assembly that can be attached to a model airplane by hand without the use of tools.

BRIEF SUMMARY OF THE INVENTION

The invention relates to an empennage assembly for a model aircraft. In an embodiment, the empennage assembly includes a fuselage having a bottom portion with an opening, a housing is positioned in the opening in the bottom portion of the fuselage. The housing includes a first end defining an opening and a second end. A rod extends from an underside of a vertical stabilizer, and a horizontal stabilizer having a hole is aligned with the opening in the bottom portion of the fuselage, the housing and the rod, whereby the rod is positioned within the opening in the first end of the housing to secure the vertical and horizontal stabilizers to the fuselage.

The invention also relates to a method for attaching an empennage assembly to a model aircraft. In an embodiment, this method includes the steps of: (1) placing a horizontal stabilizer on a top portion of an aircraft fuselage so as to align a hole in the horizontal stabilizer with an opening in a bottom portion of the fuselage; (2) inserting a housing in the opening in the bottom portion of the fuselage and the hole in the horizontal stabilizer; (3) aligning a vertical stabilizer having a rod extending from an underside thereof with the hole in the horizontal stabilizer; (4) positioning the rod in the housing; and (5) securing the housing to the rod.

DETAILED DESCRIPTION OF THE INVENTION

Figure 1:
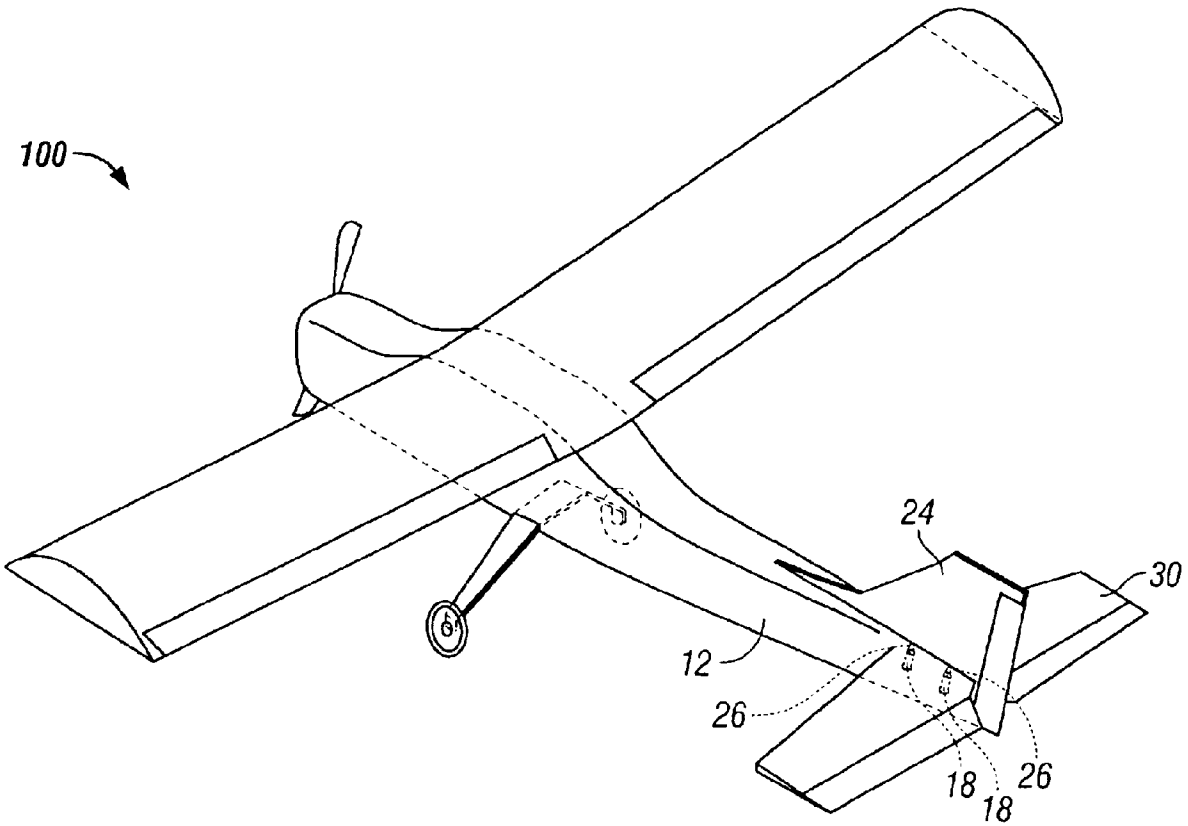
FIG. 1 is a perspective view of a model airplane utilizing the inventive empennage attachment device.
Figure 2:
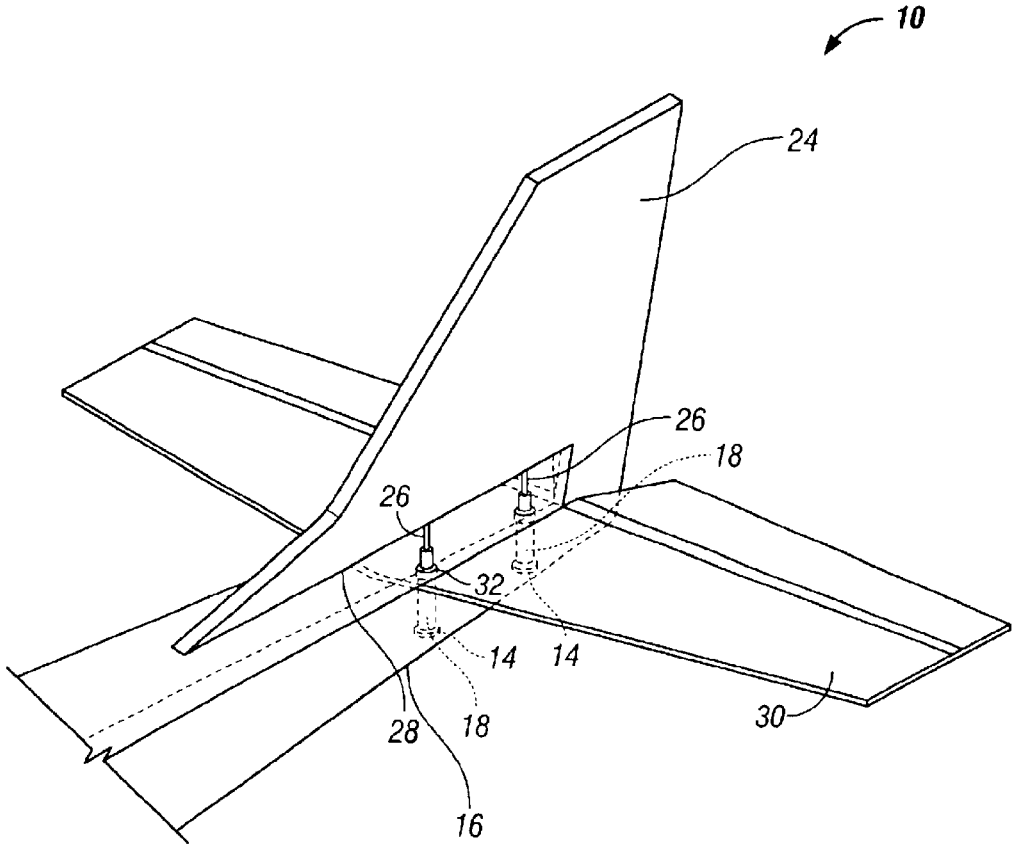
FIG. 2 is a perspective view of the empennage assembly showing a pair of rods and housings securing the vertical and horizontal stabilizers to the fuselage.
Figure 3A:
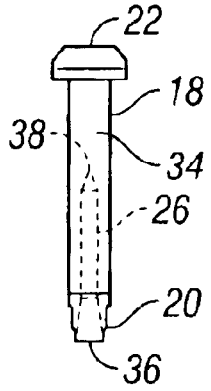
FIG. 3*a* is front view of the attachment device showing a rod positioned within a housing.
Figure 3B:
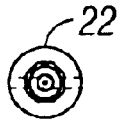
FIG. 3*b* is a top view of the housing.
Figure 3C:
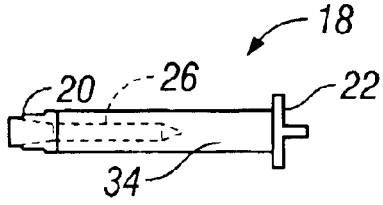
FIG. 3*c* is a side view of the attachment device showing the rod positioned within the housing.

The invention relates to an empennage assembly 10 for a model aircraft 100, such as is shown in FIG. 1. In an embodiment, as shown in FIGS. 1 and 2, the assembly 10 includes a fuselage 12 that has an opening 14 in the bottom portion 16 near the rear of the airplane. A housing 18 is positioned in the opening 14. The housing 18, as shown in FIGS. 3(*a*), 3(*c*), and 5, has a first end 20 that is open and a second end 22. The assembly 10 also includes a vertical stabilizer 24 having a rod 26 extending from its underside 28 and a horizontal stabilizer 30 that includes at least one hole 32.

When assembled, as shown in FIG. 2, the hole 32 in the horizontal stabilizer 30 is aligned with the opening 14 in the bottom portion 16 of the fuselage 12. The rod 26 extending from the underside 28 of the vertical stabilizer 24 is then inserted through the hole 32 in the horizontal stabilizer 30 to engage the open end 20 of the housing 18 that has been inserted through the opening 14 in the bottom portion 16 of the fuselage 12. The rod 26 is then secured within the housing 18, thereby attaching the vertical and horizontal stabilizers 24, 30 to the fuselage 12.

In an embodiment, the housing 18 may be a self-threading housing 18. The rod 26 extending from the vertical stabilizer 24 may also be threaded. In another embodiment, as shown in FIGS. 3(*a*), 3(*c*) and 5, the housing 18 may include a cylindrical portion 34 having an inner conic shape that is adapted to center the rod 26 in the cylindrical portion 34. In still another embodiment, the second end 22 of the housing 18 forms a finger-grip bolt head, as shown in FIG. 3(*b*). This finger-grip bolt head 22 allows the empennage assembly 10 to be secured to the fuselage 12 without the use of tools.

Figure 4:
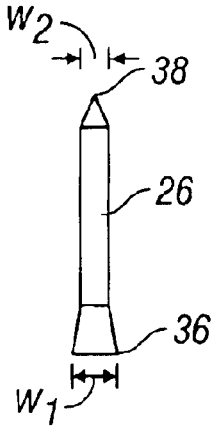
FIG. 4 is a front view of the rod used with the attachment device.
Figure 5:
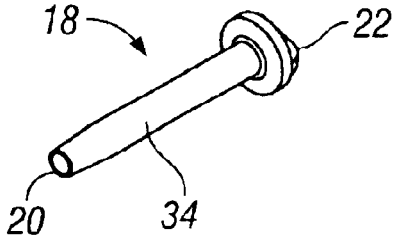
FIG. 5 is a perspective view of the housing used with the attachment device.

The rod 26 extending from the vertical stabilizer 24 has, in an embodiment, a first end 36 and a second end 38 with the first end 36 secured to the underside 28 of the vertical stabilizer 24, as shown in FIG. 2. In an embodiment, as shown in FIG. 4, the first end 36 of the rod 26 has a first width $w_1$, the second end 38 has a second width $w_2$ and the width $w_1$ of the first end 36 is greater than the width $w_2$ of the second end 38. This tapering of the rod 26 allows for it to be easily centered in the cylindrical portion 34 of the housing 18.

The rod 26 may be a threaded rod 26 with both the first and second ends 36, 38 threaded. In an embodiment, the first end 36 of the rod 26 may be secured to the underside 28 of the vertical stabilizer 24 by any means known in the art, including, but not limited to, glue. The rod 26 may also be made of any known suitable material, including, but not limited to, steel.

In an embodiment, the opening 14 in the bottom portion 16 of the fuselage 12 may be one of a plurality of openings 14. In such an embodiment, a housing 18 is positioned in each of the openings 14 and a plurality of rods 26 extends from the underside 28 of the vertical stabilizer 24. The horizontal stabilizer 30 also includes a plurality of holes 32 and each of the holes 32 aligns with one of the housings 18 and one of the plurality of rods 26. This embodiment allows for a more secure assembly in that the vertical and horizontal stabilizers 24, 30 are secured to the fuselage 12 at more than one point. FIG. 2 shows a version of this embodiment in which two attachment points are used to connect the empennage assembly 10.

The invention also relates to a method for attaching an empennage assembly 10 to a model aircraft. The method is comprised of the steps of: (1) placing a horizontal stabilizer 30 on a top portion 40 of an aircraft fuselage 12 so as to align a hole 32 in the horizontal stabilizer 30 with an opening 14 in a bottom portion 16 of the fuselage 12; (2) inserting a housing 18 in the opening 14 in the bottom portion 16 of the fuselage 12 and the hole 32 in the horizontal stabilizer 30; (3) aligning a vertical stabilizer 24 having a rod 26 extending from an underside 28 thereof with the hole 32 in the horizontal stabilizer 30; (4) positioning the rod 26 in the housing 18; and (5) securing the housing 18 to the rod 26.

In an embodiment, the method further comprises the step of gluing the rod 26 to the underside 28 of the vertical stabilizer 24. The housing 18 used in conjunction with the inventive method may be self-threading, and the rod 26 may also be threaded. In an embodiment, the method may also include the step of screwing the self-threaded housing 18 to the threaded rod 26.

The invention also relates to a device for attaching an empennage assembly 10 to a model aircraft. The device is comprised of a housing 18 and a rod 26, as shown in FIGS. 3(*a*)–3(*c*). The housing 18 may be a self-threading housing 18, and the rod 26 may also be threaded. In an embodiment, the housing 18 includes a first end 20 having an opening, a cylindrical portion 34 and an inner conic shape that is adapted to center the rod 26 in the cylindrical portion 34. One or both ends 36, 38 of the rod 26 may be threaded and a second end 22 of the housing 18 may be in the form of a finger-grip bolt head.

In an embodiment, the rod 26 may taper from the first end 36 to the second end 38. The rod 26 may also be made of any suitable material, including, but not limited to, steel.

The use of the terms "a," "an," "the" and similar referents in the context of describing the invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only and should not be taken as limiting the scope of the invention.

What is claimed is:

1. An empennage assembly for a model aircraft, the assembly comprised of:

a fuselage having a bottom portion with an opening;

a self-threading housing positioned in the opening in the bottom portion of the fuselage, the housing having a first end defining an opening and a second end;

a rod extending from an underside of a vertical stabilizer; and a horizontal stabilizer having a hole aligned with the opening in the bottom portion of the fuselage, the housing and the rod, whereby the rod is positioned within the opening in the first end of the housing to secure the vertical and horizontal stabilizers to the fuselage.

2. The assembly of claim 1, wherein the housing is a self-threading housing.

3. The assembly of claim 1, wherein the rod is threaded.

4. The assembly of claim 1, wherein the housing includes:

a cylindrical portion; and an inner conic shape that is adapted to center the rod in the cylindrical portion.

5. The assembly of claim 1, wherein the second end of the housing forms a finger-grip bolt head.

6. The assembly of claim 1, wherein:

the rod has a first end and a second end; and the first end is secured to the underside of the vertical stabilizer.

7. The assembly of claim 6, wherein:

the first end has a first width;

the second end has a second width; and the first width is greater than the second width.

8. The assembly of claim 6, wherein:

both the first end and the second end are threaded; and the first end is glued to the underside of the vertical stabilizer.

9. The assembly of claim 1, wherein the rod is made of steel.

10. The assembly of claim 1, wherein:

the opening is one of a plurality of openings;

a housing is positioned in each of the plurality of openings;

a plurality of rods extend from the underside of the vertical stabilizer; and the horizontal stabilizer has a plurality of holes, each of the plurality of holes aligned with one of the housings and one of the plurality of rods, whereby the each rod is positioned within one of the housings to secure the vertical and horizontal stabilizers to the fuselage.

* * * * *